US010750832B2

(12) United States Patent
Chevallier et al.

(10) Patent No.: US 10,750,832 B2
(45) Date of Patent: Aug. 25, 2020

(54) SETTING SYSTEM FOR A TIMEPIECE OR PIECE OF JEWELRY

(71) Applicant: Cartier International AG, Steinhausen (CH)

(72) Inventors: Gabriel Chevallier, Allinges (FR); Romain Moyse, Montlebon (FR)

(73) Assignee: Cartier International AG, Steinhausen (CH)

( * ) Notice: Subject to any disclaimer, the term of this patent is extended or adjusted under 35 U.S.C. 154(b) by 225 days.

(21) Appl. No.: 15/541,517

(22) PCT Filed: Jan. 4, 2016

(86) PCT No.: PCT/IB2016/050020
§ 371 (c)(1),
(2) Date: Jul. 5, 2017

(87) PCT Pub. No.: WO2016/110791
PCT Pub. Date: Jul. 14, 2016

(65) Prior Publication Data

US 2018/0014612 A1 Jan. 18, 2018

(30) Foreign Application Priority Data

Jan. 7, 2015 (CH) ..... 00019/15

(51) Int. Cl.
*A44C 17/02* (2006.01)
*G04B 47/04* (2006.01)

(52) U.S. Cl.
CPC ..... *A44C 17/0275* (2013.01); *G04B 47/042* (2013.01)

(58) Field of Classification Search
CPC ..... A44C 17/0275; G04B 47/042
(Continued)

(56) References Cited

U.S. PATENT DOCUMENTS 680,873 A * 8/1901 Lord ..... A44C 1/00 63/20
770,880 A * 9/1904 Weiss ..... A44B 1/40 24/112

(Continued)

FOREIGN PATENT DOCUMENTS

EP 2510824 A1 10/2012
GB 651734 A * 4/1951 ..... A44C 17/02

(Continued)

OTHER PUBLICATIONS

International Search Report of PCT/IB2016/050020, dated Mar. 10, 2016, 2 pages.

*Primary Examiner* — Jack W Lavinder
(74) *Attorney, Agent, or Firm* — Blank Rome LLP

(57) ABSTRACT

The invention relates to a setting system (1) for a timepiece or piece of jewelry (6). Said system includes: —a setting mounting (3);—a precious stone (2) mounted in or on the setting mounting (3); and—a resilient element (5) attached to the setting mounting (3) so as to flexibly connect the setting mounting (3) to said piece (6). The resilient element (5) has a stiffness between $1.2\times10^{-5}$ N/m and 1.4 N/m$\times10^{+1}$, and the combined mass of the setting mounting (3) and the precious stone (2) is between $3\times10^{-4}$ g and $4\times10^{-1}$ g such that the setting mounting (3) can be oscillated and maintained by movements of the wearer of the piece (6). And when oscillating, the setting mounting (3) oscillates according to an axial and/or radial movement relative to an axis (15) of symmetry at an oscillation frequency between 1 Hz and 30 Hz.

13 Claims, 4 Drawing Sheets

(58) Field of Classification Search
USPC ..... 63/31
See application file for complete search history.

(56) References Cited

U.S. PATENT DOCUMENTS 1,394,670 A * 10/1921 Da Costa ..... A63H 5/00 446/422
2,586,787 A * 2/1952 Conto ..... A44C 7/002 63/14.6
5,530,970 A * 7/1996 Knutson ..... G09F 21/02 2/209.13
6,003,521 A 12/1999 Huang
6,047,709 A * 4/2000 Tu ..... A45D 8/00 132/273
6,164,292 A * 12/2000 Di Maria Poole ..... A44C 17/0216 132/273
6,325,073 B1 * 12/2001 Di Maria Poole ..... A44C 17/0216 132/273
6,433,483 B1 8/2002 Michael et al.
D475,319 S * 6/2003 Di Maria Poole ..... D11/91
D487,032 S * 2/2004 Poole ..... D11/91
D550,549 S * 9/2007 Mounce ..... D8/395
9,971,308 B2 * 5/2018 Chevallier ..... G04B 47/042
2012/0151963 A1 * 6/2012 Dobashi ..... A44C 17/0258 63/26
2013/0239613 A1 * 9/2013 Shah ..... A44C 17/0275 63/27

FOREIGN PATENT DOCUMENTS

JP 2010046218 A * 3/2010 ..... A44C 17/0275
RU 100367 U1 10/2012
WO WO-2012/115458 A2 8/2012

* cited by examiner

SETTING SYSTEM FOR A TIMEPIECE OR PIECE OF JEWELRY

RELATED APPLICATIONS

This application is a national phase of PCT/IB2016/050020, filed on Jan. 4, 2016, which claims the benefit of Swiss Application No. 00019/15, filed on Jan. 7, 2015. The content of these applications are hereby incorporated by reference.

TECHNICAL FIELD

The present invention relates to a setting system for a timepiece or jewelry item in which a gemstone is mounted so as to give a visual vibrating effect to the stone. The present invention also relates to a watch dial and a timepiece or jewelry item comprising such a setting system.

STATE OF THE ART

Setting systems allow one or more precious stones to be mounted onto a support. When the stone is mounted in a fixed manner on the support, it is difficult to see the light reflected through the various facets of the stone since the movements of the stone are much reduced. Such an assembly is therefore not optimal when a certain animation effect is sought. For this reason, setting systems include spring elements or optical means in order to produce an animation effect.

In patent U.S. Pat. No. 6,433,483, a jewelry item comprises diamonds being illuminated with the aid of a light source. A controller controls the light source so as to vary the intensity of the light emitted by the source, thus enabling the optical effects of the diamond to be more enhanced. It is however often undesirable to use electronic devices in high-end timepieces or jewelry items.

Document EP2510824 describes a jewelry item comprising a precious stone fastened in a bezel mounted on a pivot element of plastic or elastomer. Although the stone-bezel unit can move, its movement on the pivot element does not provide a visual effect of the stone vibrating.

Utility model RU100367U describes a jewelry item comprising a precious stone fastened in a disc-shaped bezel, this stone-bezel unit being connected to a base of the item by a cylindrical spring. The vibration of the stone mounted on the spring causes a light refraction effect. Fastening the ends of the spring to the bezel and to the base is however complicated and delicate. In the case of small springs, required in the case of small-size stones, the latter can deform excessively when the stone moves relative to its initial position, negatively affecting the stone's vibration movement and thus the item's aesthetic aspect. Furthermore, the sizing of the spring so as to obtain the desired visual effect makes it fragile and the spring can also become irreversibly deformed by shocks.

Patent application WO2012/115458 describes a jewelry item comprising a ring-shaped support having a hollow sector in which a bezel is mounted using a spiral or conical spring. The extremities of the spring are fastened in grooves made in the support respectively in the bezel, and the bezel is made to oscillate under the effect of external excitations on the support. According to one embodiment, a pin is mounted through the upper part of the bezel, wherein each of the extremities of the pin is lodged in the support in a plane parallel to the plane of the spring (the spring being fastened to a lower part of the bezel). The pin serves to prevent the bezel and the support from separating in the case of serious shocks. According to this document, with this construction, the lower part of the bezel can only vibrate in a direction perpendicular to the pin in the plane of the spring, and the upper part of the bezel remains effectively integrally united with the support.

Although such an item is less likely to accidentally separate from the bezel and/or for the spring to deform following a serious shock, the oscillations of the bezel are much too limited by the pin that significantly absorbs them continuously. This consequently denies the item's desired visual effect or even the vibration or movement of the stone.

More generally, the systems as drawn and presented in these prior art documents are not configured so as to give a visual vibration effect, or even a vibration frequency, sufficiently useful for an observer, in particular in the case of small stones such as the size of stones typically used to crimp a dial or watch box at high density.

BRIEF SUMMARY OF THE INVENTION

One aim of the present invention is to propose a setting system for a timepiece or jewelry item free from the limitations of the known state of the art.

Another aim of the invention is to obtain a setting system allowing much easier and more reliable mounting of the stone as compared with the known systems and better suited to the use of stones of small dimensions.

According to the invention, these aims are achieved notably by means of a setting system for a timepiece or jewelry item comprising a crimping support, a precious stone mounted in or on the crimping support; a flexible/resilient member fastened to the crimping support in such a way as to flexibly link the crimping support to said item; wherein the resilient member has a stiffness comprised between $1.2\times10^{-5}$ N/m and $1.4\times10^{+1}$ N/m; and the combined mass of the crimping support and of the precious stone is comprised between $3\times10^{-4}$ g and $4\times10^{-1}$ g, so that the crimping support can be made to oscillate and sustained by the movements of the wearer of the item; and, when it oscillates, the crimping support oscillates along an axial and/or radial movement relative to an axis of symmetry, with a frequency comprised between 1 Hz and 30 Hz.

Particular embodiments and variants are described in the dependent claims.

The present invention also concerns a dial of a timepiece as well as a timepiece or jewelry item comprising said setting system as well as a method of manufacturing the resilient member of the setting system.

The setting system and the assembly comprising a plurality of setting systems may be advantageously included in an item such as an item of jewelry or a timepiece, so as to produce a visual effect by the oscillation of the setting system or systems following an external stimulation (movement of the wearer) of the item.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
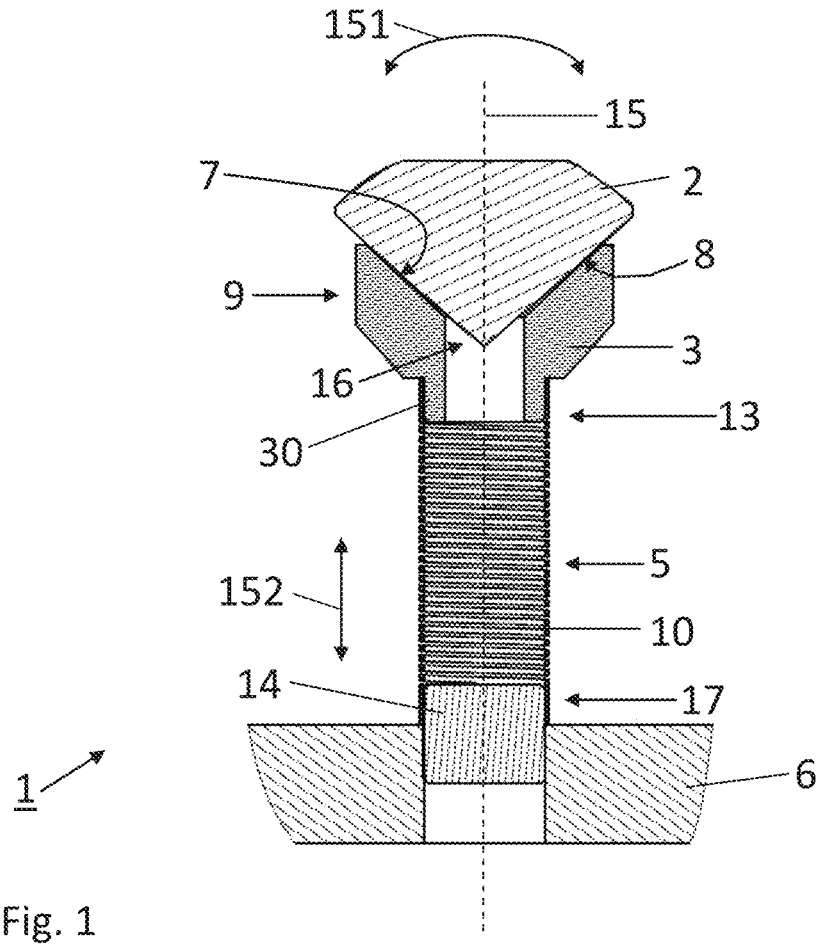
FIG. 1 illustrates a setting system comprising a crimping support, a stone and a resilient member, according to one embodiment.

A setting system 1 for a timepiece 6 or jewelry item is illustrated in FIG. 1, according to one embodiment. The setting system 1 comprises a crimping support 3, or bezel, in which is mounted a gemstone 2, such as a diamond, ruby, sapphire or emerald. It will be understood here that the term "a gemstone" means at least one gemstone 2, the support 3 being capable of supporting a plurality of gemstones 2. The term "gemstone" or "precious stone" can also encompass any type of stones, such as fine stones. A resilient (or flexible) member 5 attached to the crimping support 3 flexibly connects the crimping support 3 to the item 6. The resilient member 5 extends axially between the crimping support 3 and the item 6.

In this arrangement, the stone 2 can oscillate or vibrate on the resilient member 5 following a movement of the item 6 (in other words, so that the crimping support, and therefore the stone, can oscillate or vibrate on the resilient member 5 following a movement of the item 6). For example, during a shock or abrupt movement of the timepiece or jewelry item 6 comprising the setting system 1, the extremity 17 of the resilient member 5 attached to the item 6 remains fixed, while the remainder of the resilient member 5 deforms elastically under the effect of the acceleration of the mass of the stone 2 and of the crimping support 3. The stiffness of the resilient member 5, the mass of the stone 2 and of the crimping support 3, as well as the intensity of the impact are the main factors determining the frequency of the vibrations (or oscillations) of the stone 2. In such an arrangement, the oscillation of the stone 2 takes place in a radial movement with respect to an axis of symmetry 15 and an axial movement with respect to this same axis 15.

Since the setting system 1 is intended for a timepiece 6 or jewelry item, it must be arranged in order to be able to create an animation, for example on a watch dial, on the basis of a vibration of the stone. In other words, the setting system 1 must be configured so that the vibration of the stone is visible. The vibration must also be durable over time and in its environment of use. On the other hand, in order to accommodate the setting system 1, for example, between the dial and the watch glass, on a bezel, a jewel, its size requirement must be minimal and the dimensions of the setting system 1 will have to be reduced. This difficulty is exacerbated when a large number of stones are crimped at high density on the support.

In order for the vibration of the stone 2 to be visible, the latter's oscillation frequency must be adapted to retinal persistence. Below about 30 cycles per second, or even 25 cycles per second, the human perceives the cycles. It can then be said that a vibration whose frequency is less than 30 Hz is visible to the human eye. The amplitude of the movement must also be large enough to be perceived.

The decrease in the amplitude of the oscillations in time, i.e. the damping, must be at least greater than one period of the oscillation, and must in practice comprise several periods, so that one actual impression of a vibration is perceived by the human eye. Preferably, the vibration is sustained.

The setting system 1 can be considered with the combination of the crimping support 3 and the stone 2 as having a mass M and a resilient member 5 with a stiffness K. Stiffness is the characteristic which indicates the resistance to the elastic deformation of a body. The vibration frequencies F of the setting system 1 are defined by the inertia of the mass M of the assembly comprising the crimping support 3 and the stone 2, and the stiffness K of the resilient member 5:

$$F = 1/2\pi\sqrt{\frac{K}{M}}. \tag{1}$$

The ratio of the stiffness K to the mass M determines the vibration frequencies according to the possible directions of movement (degrees of freedom) of the setting system 1 and hence the oscillation frequency of the setting system 1 which must be less than 30 Hz, or even 25 Hz.

The vibration of the setting system 1 is therefore determined by the amplitude and the frequency according to certain modes of vibration. The amplitude and frequency of vibration are themselves defined by the materials composing the system and the geometry of the elements.

The setting system 1 must also be configured in such a way that the vibration can be initiated by natural movements of the wearer of the timepiece 6 or jewelry item. The vibration of the setting system 1 should also be maintained over time by these same natural movements of the wearer.

In the case where the resilient member 5 is modeled as a flexible beam, the stiffness is proportional to the product of the area A of the beam and the Young modulus E over the length L of the resilient member:

$$K = \frac{A \cdot E}{L}; \tag{2}$$

and the frequency F can be expressed as:

$$F = \frac{1}{2}\pi\sqrt{\frac{A \cdot E}{L \cdot M}}. \tag{3}$$

Figure 7:
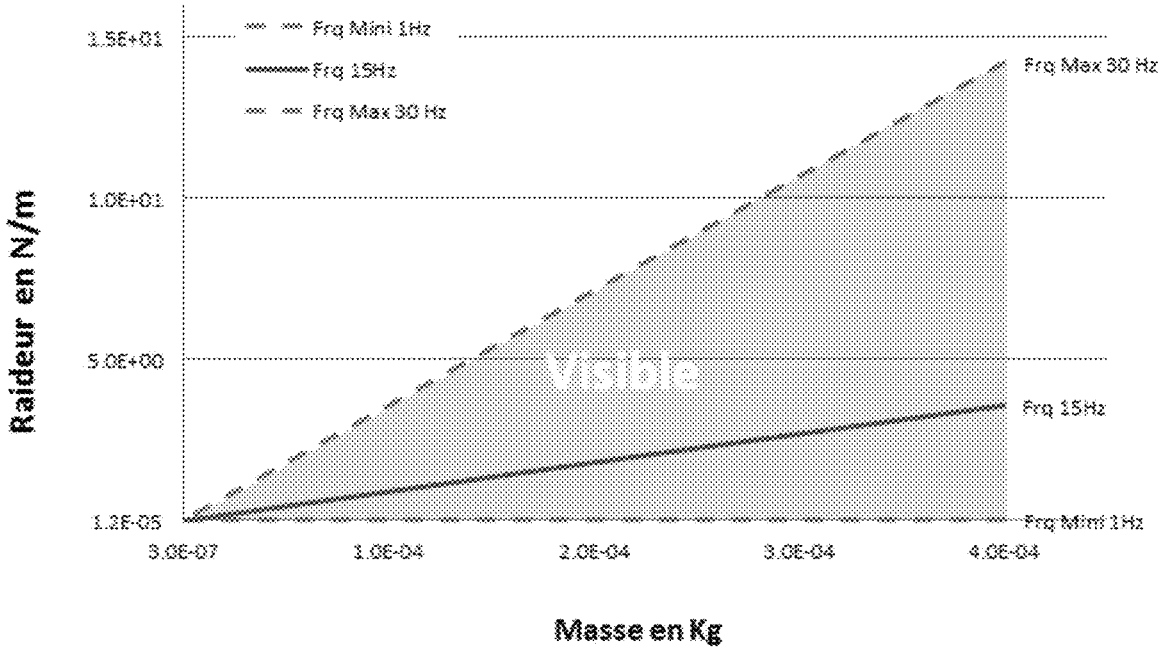
FIG. 7 shows calculated values of the stiffness of a helical spring as a function of the mass of the crimping support and of the stone, giving rise to frequencies comprised between 1 Hz and 30 Hz.

The equation (3) makes it possible to determine the minimum and maximum stiffness values K for the resilient member 5 making it possible to have the crimping support 3 with the stone 2 vibrate in the frequency range between 1 Hz and 30 Hz. FIG. 7 shows calculated values of the stiffness K as a function of the mass M of the assembly comprising the crimping support 3 and the stone 2, giving rise to frequencies of vibration perceived by the human eye, i.e. between 1 Hz and 30 Hz.

Table 1 reports spring sizing values allowing a mass to vibrate in perceptible frequencies (1 Hz to 30 Hz).

TABLE 1

| Mass (g) | Height/ diameter (mm) | Material/ stiffness (GPa) | Length of the spring (mm) | Section ($mm^2$) | Frequency (Hz) |
|---|---|---|---|---|---|
| 0.25 | 3/2 | steel/ 200-210 | 219 | 0.0078 | ~14 |
| 0.25 | 3/2 | Ti/110-120 | 219 | 0.0038 | ~19 |
| 0.25 | 3/2 | Al/70 | 219 | 0.0038 | ~15 |
| 0.25 | 3/2 | nylon/2-5 | 219 | 1.3 | ~10 |

In one embodiment, the resilient member 5 has a stiffness K comprised between $1.2\times10^{-5}$ N/m and $1.4\times10^{+1}$ N/m and the combined mass M of the crimping support 3 and of the gemstone 2 is comprised between $3\times10^{-4}$ g and $4\times10^{-1}$ g (see FIG. 7). In this configuration, the crimping support 3 can oscillate according to an axial and/or radial movement, following a movement of the item 6, with an oscillation frequency comprised between 1 Hz and 30 Hz relative to the axis of symmetry 15. According to a preferred embodiment, the combined mass M of the crimping support 3 and of the gemstone 2 is comprised between $1\times10^{-3}$ g and $1\times10^{-1}$ g and the stiffness K of the resilient member 5 is comprised between $3.9\times10^{-5}$ N/m and 3.6 N/m. In an even more preferred manner, the combined mass M of the crimping support 3 and the gemstone 2 is between $1\times10^{-2}$ *and* $5\times10^{-2}$ and the stiffness K of the resilient member 5 is between $3.9\times10^{-4}$ N/m and 1.8 N/m. According to another preferred embodiment, in which the crimping support 3 can oscillate according to an axial and/or radial movement, following a movement of the item 6, with an oscillation frequency comprised between 10 Hz and 20 Hz relative to the axis of symmetry 15, the combined mass M of the crimping support 3 and of the gemstone 2 is comprised between $1\times10^{-2}$ *g and* $5\times10^{-2}$ g, and the stiffness K of the resilient member 5 is comprised between $3.9\times10^{-2}$ N/m and $7.9\times10^{-1}$ N/m.

The frequency and amplitude of the oscillation movement following an impact on the item 6 can be limited by a combination of the stiffness of the resilient member 5 and the combined mass of the crimping support 3 and of the gemstone 2.

In one embodiment, the resilient member comprises a helical-developing spring (hereinafter "helical spring"). Such a spring 5 comprising helically wound coils 10 makes it possible to obtain a resilient member having at the same time a maximum length and a minimum bulk. In the embodiment of FIG. 1, the resilient member comprises a helical spring 5 of cylindrical section. The crimping support 3 comprises a peg 30 integral with the crimping support 3 and at least partially housed in a first extremity 13 of the spring 5, so as to fix the peg 30 to the resilient member 5 by tightening. The second extremity 17 of the spring 5 is fixed in the item 6 by at least one of the methods including clamping, driving, clipsing or welding, or any other suitable method.

A helical spring, according to this mode of attachment, oscillates mainly in flexion, it allows a tilting oscillation mode, i.e. an oscillation according to a radial movement, illustrated by the arrow numbered 151 in FIG. 1. The helical spring also allows a mode of oscillation in pumping, i.e. an oscillation according to an axial movement, illustrated by the arrow numbered 152 in FIG. 1. This mode of oscillation, however, tends to be negligible relative to the oscillation according to the radial movement. The amplitude of the axial movement of the spring 5 towards the item 6 is limited by the compression of the coils 10 of the spring 5.

Figure 2:
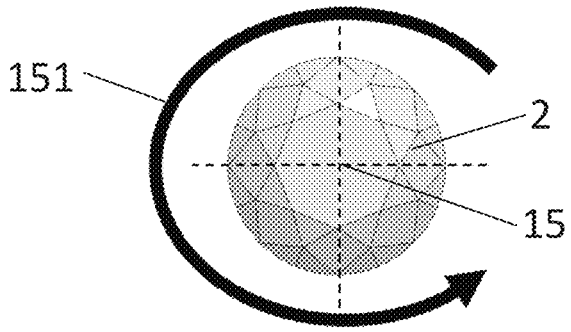
FIG. 2 shows the setting system seen on the stone side, oscillating according to a radial movement.

FIG. 2 shows the setting system 1 seen from above (on the side of the stone 2) and the oscillation according to the radial movement 151 which expresses an ellipse. The radial movement promotes a flickering effect of the stone 2.

The crimping support 3 may comprise a front part 9 of truncated cone shape and serving as a seat for the pavilion 8 of the stone 2. The inclination of the profile 7 of the front part 9 can be arranged so as to ensure that the pavilion 8 is held. The support 3 may also include a bore 16 coaxial with the support 3.

Still in the example of FIG. 1, the second extremity 17 of the spring 5 is attached to the item 6 by means of a pin 14. The pin 14 is secured, for example by driving or screwing, into the item 6 and the second extremity 17 of the spring 5 is attached, for example by clamping, to the pin 14. The distal end of the rod 18 passes through a hole in the pin 14 and is secured to the support 6 by an appropriate method such as driving, clamping or clipsing.

Figure 3:
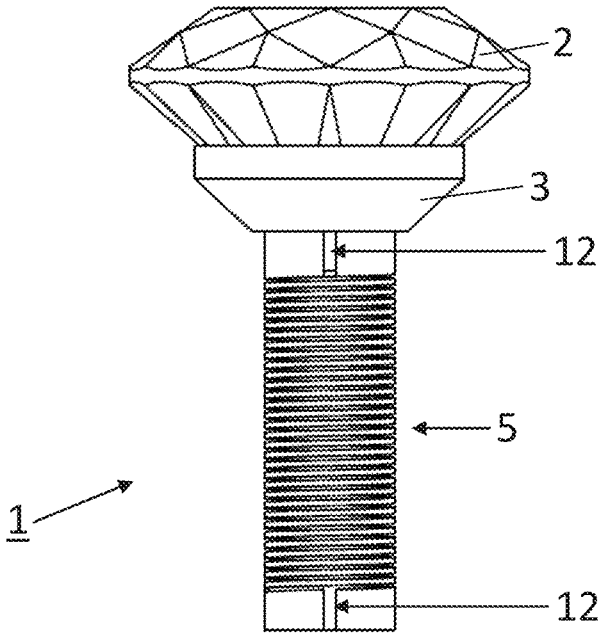
FIG. 3 illustrates a setting system, according to another embodiment.

FIG. 3 shows a setting system 1 as in FIG. 1, in which the first extremity 13 of the helical spring 5 of cylindrical section comprises an axial groove 12 which acts as an elasticity slit, enabling it to absorb radially by elastic and/or plastic deformation at least part of the effort of driving the peg 30 onto the spring 5. Such an axial groove 12 can also be provided at the second extremity 17 of the spring 5, for example to facilitate the driving, when the spring 5 is driven into the peg 14.

Figure 4:
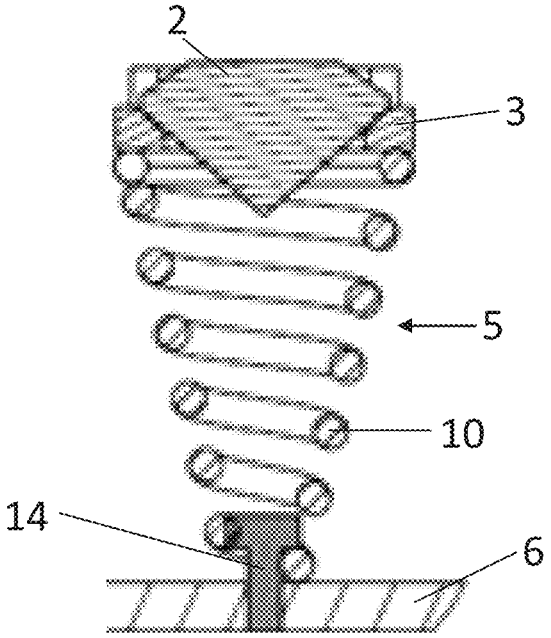
FIG. 4 shows a setting system, again according to another embodiment.

The helical spring 5 may also be of conical section. Such a setting system with a helical spring 5 of conical section is shown in FIG. 4.

Figure 5:
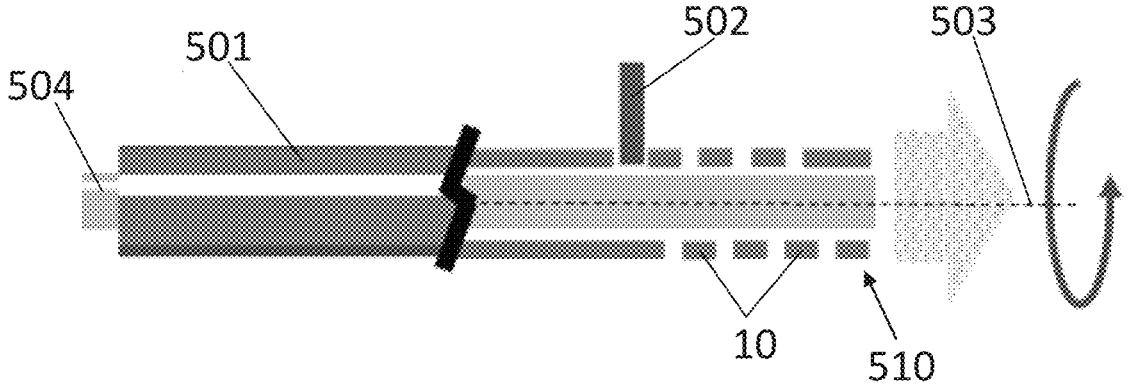
FIG. 5 illustrates a method for manufacturing a helical spring, according to one embodiment.

In an embodiment illustrated in FIG. 5, the helical spring 5 is produced by a helical cutting using a laser from a tube 501. The cutout may be made by rotating the tube 501 around its axis of symmetry 503 and simultaneously advancing the tube 501, so that a fixed laser beam 502 can cut the helical shape of the coils 10. FIG. 5 shows a tube 501 for which the helical cut has been partially done. For cutting, the tube 501 can be mounted on a rod 504. Alternatively, the tube 501 to be cut is fixed and the laser is movable. Preferably, the laser is of the femtosecond laser type, which is suitable for machining small objects.

The speed of rotation of the tube 501 is determined from the diameter d of the tube 501 to correspond to a sublimation speed of the material of the tube 501 conditioned by the properties of the laser beam and the material of the tube 501. The advance of the tube 501, i.e. its speed of displacement along the axis of symmetry 503, is then determined in such a way that the displacement of the tube along the axis of symmetry 503 and during a time period corresponding to a complete revolution of the tube 501, with the rotational speed determined above, corresponds to the desired thickness of the coil 10 for the spring 5 to be produced. This determination is valid for a sublimation diameter generated by the laser, i.e. for a certain energy level (or power and pulse) of the laser. The advance of the tube 501 and its rotation therefore define the pitch and the height of the coils 10 of the spring 5 thus manufactured. The thickness of the coils 10 is defined by the thickness of the wall of the tube 501. In such an embodiment of the spring 5, the section of the coils 10 is rectangular.

The axial groove 12 can be cut in the above-described process. For example, the cut is initiated at one of the extremities of the tube 510 by the formation of the axial groove 12, for example at the first extremity 13, and is followed by the cutting of the coils 10. The cutting is terminated at the other extremity of the tube 510 by the formation of another axial groove 12, for example at the second extremity 17.

Figure 6:
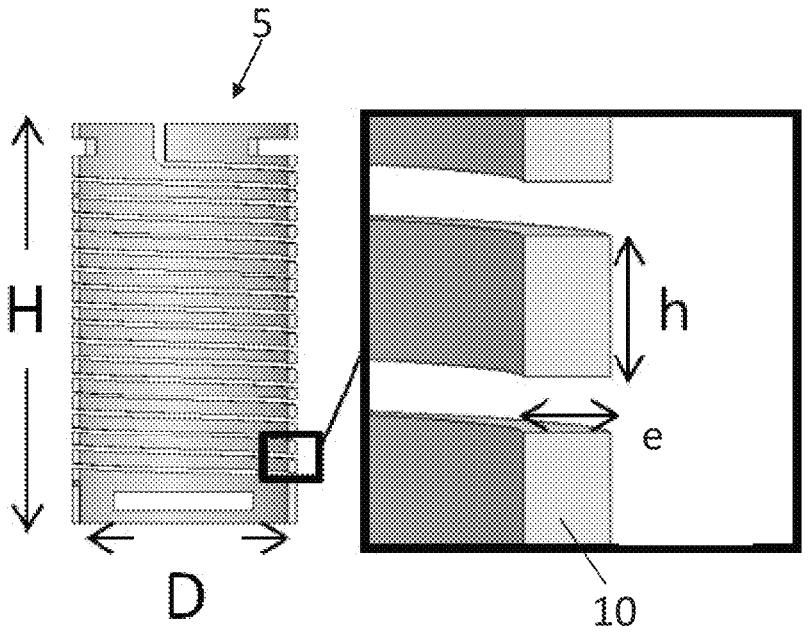
FIG. 6 shows a helical spring made by cutting through a tube.

FIG. 6 shows a helical spring 5 made by cutting in a tube. A detail of the coils 10 is also shown. The stiffness of the spring 5 depends on the material in which the spring 5 is made; the length of the spring 5, defined by the diameter of the helicoid, the pitch, and the height H; and the section of the coils 10 which is determined by the thickness e of the wall of the tube 501 and by the height h of the coils 10. The height of the coils 10 is defined by the pitch and the space between the coils 10 (i.e. the quantity of material cut between two coils).

The fact that the shape of the helical spring 5 has a small footprint encourages a dense implantation of the setting system 1 on an item 6 (jewel, watch dial, etc.) since the diameter D of the spring 5 may be smaller than the dimensions of the crimping support 3 and of the stone 2. Thus, a plurality of setting systems 1 may be disposed on the item 6 so that the stones 2 are brought closer together to one another. The diameter D of the spring 5 can be determined by the fastening means 14.

The bulk of the setting system 1 can be reduced by maximizing the mass of the crimping support 3, which makes it possible to reduce the size of the support 3. For example, the crimping support 3 may be made of a material having a high density, such as gold or a gold alloy.

The bulk of the setting system 1 can also be minimized by a section of coil as small as possible. However, for reasons of process and robustness of the manufactured spring, the thickness of the tube, and therefore of the coils 10, is preferably greater than 20 μm and even more preferably greater than 40 μm.

For a given spring length, the height h of the coils 10 makes it possible to adjust the stiffness K of the spring 5 so as to obtain an aesthetic vibration frequency, i.e. an oscillation frequency of between 1 Hz and 30 Hz, depending on the mass of the system. It should be noted here that other parameters of the spring 5, such as the component material, can be adjusted in order to obtain different frequencies. The choice of adjusting the height h of the coils is based on practical reasons, such as the adjustment of the laser.

It may be advantageous for the pitch to be as small as possible so as to have a considerable length L of the resilient member 5 and thus reduce the height H of the spring 5. On the other hand, the height h of the coil can be as small as possible so that the length L of the resilient member 5 need no longer be maximum. In these two limiting cases, the stiffness K of the spring 5 in its axial direction contributes to the crushing of one coil 10 on the other and therefore to the decrease in the space between the coils 10. However, it is not desirable for the coils to touch during the vibration in order to minimize the damping of the vibration. The length L of the spring element 5 and the height of the coils 10 are therefore preferably between a maximum length L and a minimum coil height h. These dimensions will minimize the vibration of the spring along an axial movement.

It goes without saying that the present invention is not limited to the embodiments which have just been described and that various modifications and simple variants can be conceived by a person skilled in the art without departing from the scope of the present invention.

Figure 8:
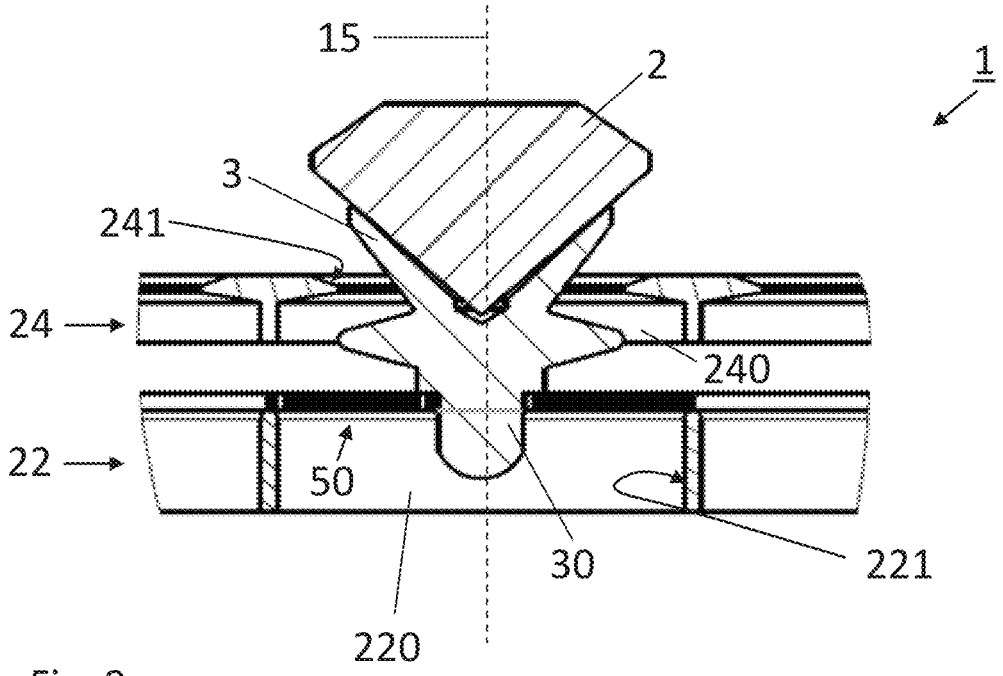
FIG. 8 shows the setting system according to another embodiment.

For example, in the example illustrated in FIG. 8, the resilient member comprises a flat spring 50 extending radially from the crimping support 3. This flat spring may be manufactured by the method described above, for example by cutting into a plate. In this particular example, the flat spring 50 is mounted on a first rigid support element 22 extending radially and capable of being attached to the item 6 and comprising a first opening 220. The flat spring 50 allows the crimping support 3, and thus the stone 2, to oscillate or vibrate radially and axially by deformation of the spring 50 following a movement of the item 6. The setting system 1 comprises a second support element 24 extending radially above the first support element 22. The second support element 24 comprises a second opening 240 concentric with the first opening 220. In this configuration, the radial oscillation amplitude of the stone 2 is limited by the crimping support 3 coming into abutment against the side wall 241 of the opening 240. The crimping support 3 may also comprise a peg 30 extending distally in the first support element 22. The radial movement of the stone 2 is limited by the peg 30 of the crimping support 3 coming into abutment against a wall 221 of the first opening 220, thus limiting the radial movement of the stone 2.

REFERENCE NUMBERS USED IN THE FIGURES

1 setting system
10 coil
12 axial groove
13 first extremity of the spring
14 pin
15 axis of symmetry
151 radial movement
152 axial movement
16 bore
17 second extremity of the spring
2 precious stone
22 first support element
220 first opening
221 side wall
24 second support element
240 second opening
241 side wall
3 crimping support
30 peg
5 resilient member
50 flat spring
501 tube
502 laser beam
503 axis of symmetry
504 rod
510 extremity of the tube
6 timepiece or jewelry item
30 peg
7 profile
8 pavilion
9 frontal part
A area of the beam
d tube diameter
D spring diameter
e thickness of the wall of the tube
E Young modulus
F frequency
h height of coils
H height of spring
K stiffness of spring
L length of resilient member
M mass

The invention claimed is:

1. Setting system for a timepiece or jewelry item comprising:

a crimping support;

a precious stone mounted in or on the crimping support;

a resilient member fastened to the crimping support to flexibly link the crimping support to said timepiece or jewelry item, wherein the resilient member extends axially between the crimping support and the timepiece or jewelry item;

wherein the resilient member has a stiffness comprised between $1.2\times10^{-3}$ N/m and $1.4\times10^{+1}$ N/m; and wherein a combined mass of the crimping support and of the precious stone is comprised between $3\times10^{-4}$ g and $4\times10^{-1}$ g;

wherein the crimping support is adapted to oscillate and be sustained by movements of a wearer of the timepiece or jewelry item; and, when the crimping support oscillates, the crimping support oscillates along an axial, a radial, or a combination of an axial and a radial movement relative to an axis of symmetry, with an oscillation frequency comprised between 1 Hz and 30 Hz, wherein an amplitude of the axial movement of the resilient member towards the timepiece or jewelry item is limited by the compression of coils of the resilient member.

2. The setting system according to claim 1, wherein the stiffness comprised between $3.9\times10^{-5}$ N/m and 3.6 N/m; and the combined mass of the crimping support and of the precious stone is comprised between $1\times10^{-3}$ g and $1\times10^{-1}$ g.

3. The setting system according to claim 1, wherein the stiffness is between $3.9\times10^{-4}$ N/m; and 1.8 N/m; and the combined mass of the crimping support and of the precious stone is comprised between $1\times10^{-2}$ g and $5\times10^{-2}$ g.

4. The setting system according to claim 1, wherein the oscillation frequency is comprised between 10 Hz and 20 Hz;

and wherein the stiffness is comprised between $3.9\times10^{-2}$ N/m and $7.9\times10^{-1}$ N/m; and the combined mass of the crimping support and of the precious stone is comprised between $1\times10^{-2}$ g and $5\times10^{-2}$ g.

5. The setting system according to claim 1, wherein the oscillation frequency is limited by a combination of the stiffness of the resilient member and the combined mass of the crimping support and of the precious stone.

6. The setting system according to claim 1, wherein the resilient member comprises a flat spring extending radially from. the crimping support.

7. The setting system according to claim 6, wherein the cross-section of the coils of the spring is rectangular.

8. The setting system according to claim 1, wherein the precious stone is a diamond and the crimping support is made of gold or a gold alloy.

9. The setting system according to claim 1, wherein the resilient member comprises a vertical helical spring.

10. The setting system according to claim 9, wherein the spring is of conical section.

11. The setting system according to claim 9, wherein the spring has a cylindrical cross-section.

12. A timepiece comprising:

a setting system comprising a crimping support;

a precious stone mounted in or on the crimping support;

a resilient member fastened to the crimping support in such a way as to flexibly link the crimping support to said timepiece, wherein the resilient member extends axially between the crimping support and the timepiece;

wherein the resilient member has a stiffness comprised between $1.2\times10^{-5}$ N/m and $1.4\times10^{+1}$ N/m; and wherein a combined mass of the crimping support and of the precious stone is comprised between $3\times10^{-4}$ g and $4\times10^{-1}$ g;

wherein the crimping support is adapted to oscillate and be sustained by movements of a wearer of the timepiece; and, when the crimping support oscillates, the crimping support oscillates along an axial or radial movement or a combination of an axial and radial movement relative to an axis of symmetry, with a frequency comprised between 1 Hz and 30 Hz, wherein an amplitude of the axial movement of the resilient member towards the timepiece is limited by the compression of coils of the resilient member.

13. Timepiece or jewelry item comprising a setting system comprising a crimping support;

a precious stone mounted in or on the crimping support;

a resilient member fastened to the crimping support in such a way as to flexibly link the crimping support to said timepiece or jewelry item, wherein the resilient member extends axially between the crimping support and the timepiece or jewelry item;

wherein the resilient member has a stiffness comprised between $1.2\times10^{-5}$ N/m and $1.4\times10^{+1}$ N/m; and wherein a combined mass of the crimping support and of the precious stone is comprised between $3\times10^{-4}$ g and $4\times10^{-1}$ g;

wherein the crimping support is adapted to oscillate and be sustained by movements of a wearer of the timepiece or jewelry item; and, when the crimping support oscillates, the crimping support oscillates along an axial or radial movement or a combination of an axial and a radial movement relative to an axis of symmetry, with a frequency comprised between 1 Hz and 30 Hz, wherein an amplitude of the axial movement of the resilient member towards the timepiece or jewelry item is limited by the compression of coils of the resilient member.

* * * * *